United States Patent [19]

Oram

[11] 4,002,707

[45] Jan. 11, 1977

[54] METHOD AND APPARATUS FOR THE CONSTRUCTION OF CONCRETE SHELLS

[76] Inventor: Michael Allen Oram, 1022 Neil Ave., Columbus, Ohio 43201

[22] Filed: June 23, 1975

[21] Appl. No.: 589,459

[52] U.S. Cl. ..... 264/31; 52/382; 249/65; 264/32; 264/314

[51] Int. Cl.[2] ..... E04B 1/16

[58] Field of Search ..... 264/31, 32, 34, 35, 264/314; 249/65; 52/2, 382

[56] References Cited

UNITED STATES PATENTS

| | | | |
|---|---|---|---|
| 1,964,386 | 6/1934 | Nose | 249/65 X |
| 3,072,995 | 1/1963 | Buxton | 264/314 |
| 3,104,441 | 9/1963 | Smith | 249/65 |

FOREIGN PATENTS OR APPLICATIONS

| | | | |
|---|---|---|---|
| 594,955 | 11/1947 | United Kingdom | 249/65 |

*Primary Examiner*—Robert F. White
*Assistant Examiner*—Thomas P. Pavelko
*Attorney, Agent, or Firm*—Frank Kremblas

[57] ABSTRACT

A method of constructing concrete shells of various design employing a plurality of inflatable water filled bladders which are aggregated to produce a mold having the configuration of the final structure. After a conventional concrete shell, which is formed by depositing concrete over the desired mold, has set, the bladders are drained, removed from the shell, and ready for reuse.

1 Claim, 11 Drawing Figures

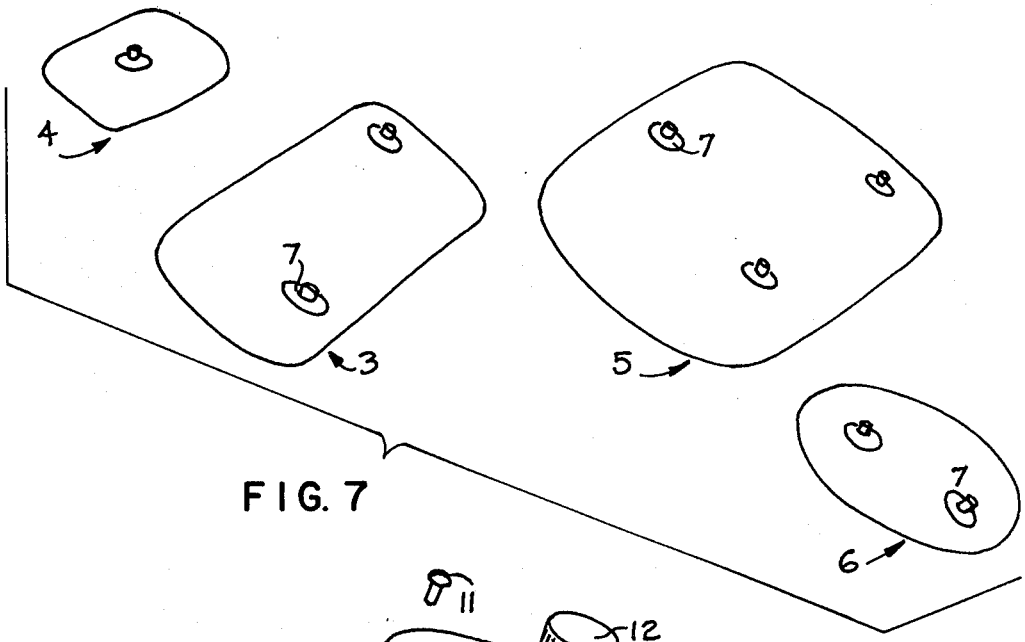
FIG. 7
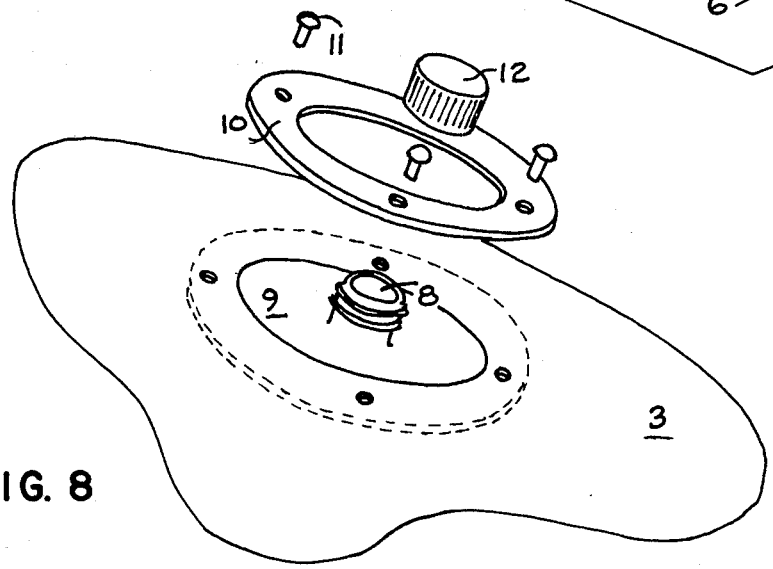
FIG. 8
FIG. 9
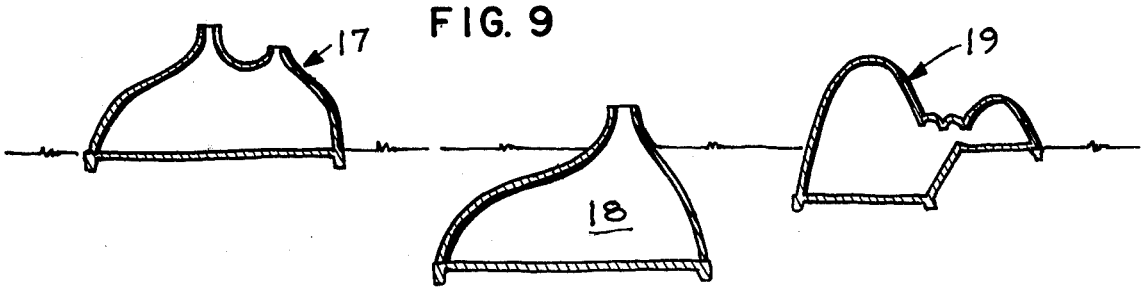

METHOD AND APPARATUS FOR THE CONSTRUCTION OF CONCRETE SHELLS

BACKGROUND OF THE INVENTION:

Concrete shell design has become quite popular, but the complexities of forming these structures have often resulted in uneconomic solutions.

Various schemes for the economic construction of concrete shells employing inflatable forms have been presented. Most of these schemes employ a single, large air filled balloon as the forming vehicle.

This solution has two apparent faults.

1. The air in such a balloon, since it is readily compressed, would have to be at a high pressure in order to withstand the combined weight of the concrete and steel reinforcing members.

2. The single large balloon would seem to have only limited potential for reuse since there is no way to introduce design differentiation into the final product without fabricating a completely new balloon.

This invention offers a solution to the problems cited above. The basis of this invention relies on the fact that water is a virtually incompressible fluid that takes the shape of its container and unless that container is rigid, is subject to distortion. This invention utilizes water filled bladders of sufficiently small dimension such that when the bladders are laid up in an overlapping and interlocking "building block" fashion, the weight of the water and the restraining characteristics of the fabric in the bladders create a stable mold that is capable of supporting a concrete shell while undergoing a minimum of distortion. The water filled bladders could be manufactured in several different sizes so that when a plurality of such bladders was aggregated, the design possibilities for the resultant mold would be limitless. The utilization of such a concrete shell forming technique could have significant implications for the housing industry since relatively low cost structures could be fabricated which would preserve freedom of design while employing relatively unskilled labor.

SUMMARY OF THE INVENTION:

It is the principal object of this invention to provide a new and improved method of forming concrete shell structures employing waterfilled bladders that can be recovered and repeatedly used.

A further object of this invention is to provide an inflatable fabric bladder which is the basis for the new concrete shell forming technique. The sequence of events summarizing the forming technique follows: At the site of the intended structure, conventional concrete footers and a concrete slab on grade are prepared. The fabric bladders are delivered to the site and a single layer of bladders is laid out in such a way that the area covered by the bladders corresponds to the plan of the structure. The fabric bladders are filled with water, and another layer of bladders is stretched out on the bladders below. The second layer of bladders is filled, and the process repeats itself until the waterfilled bladders have achieved the desired shape of the structure. Wire mesh reinforcement is fashioned to conform to the shape of the mold. A conventional concrete shell is poured or sprayed on the mold and allowed to set. When the concrete shell is sufficiently hard, access to the waterfilled bladders is gained through a preformed opening in the concrete shell. A hose is connected to one of the uppermost bladders and it is drained. As the bladders are sequentially drained, they are removed through the preformed opening and can then be transported to a new site where they can be assembled in a different configuration and the process is ready for repetition.

BRIEF DESCRIPTION OF THE DRAWINGS:

FIG. 7 illustrates a typical rubberized fabric bladder and possible variation thereof FIG. 8 illustrates in exploded detail of a typical bladder fill hole and assembly FIG. 9 illustrates a possible application of concrete shell design

Figure 1:
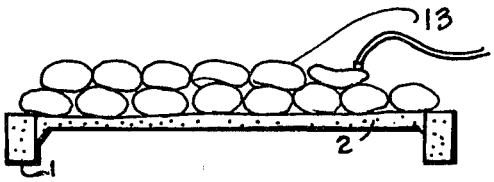
FIGS. 1–6 illustrate a diagramatic presentation of the shell formation technique
Figure 4:
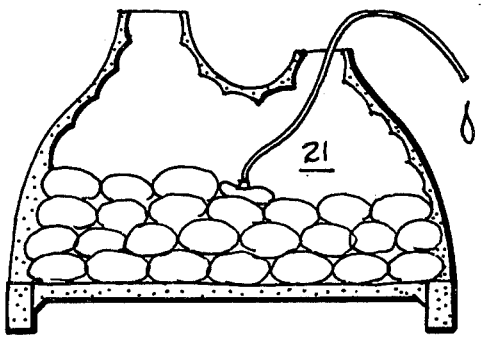
Figure 2:
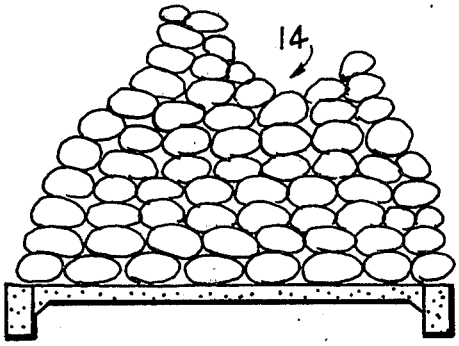
Figure 5:
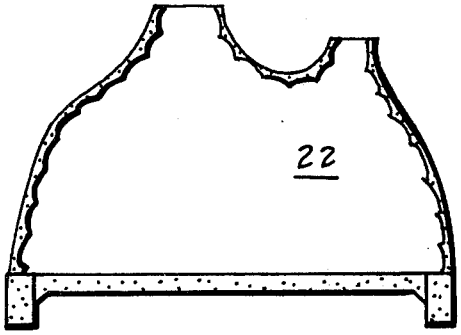
Figure 3:
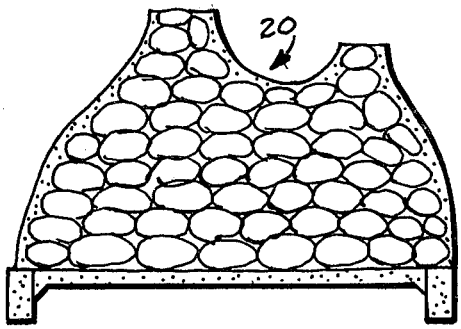
Figure 6:
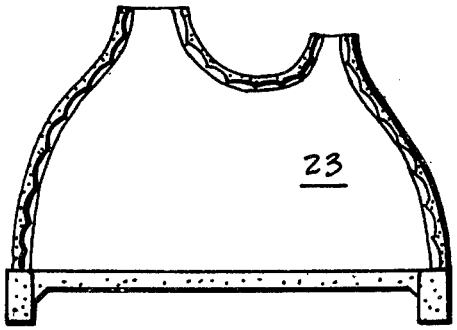
Figure 10:
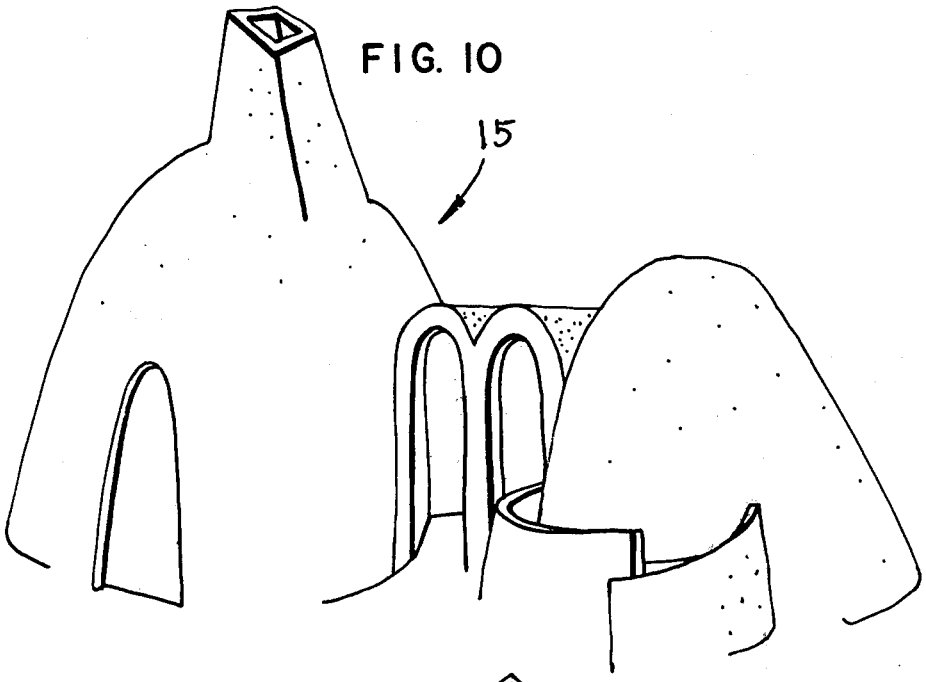
FIGS. 10 and 11 illustrate residential shells showing design freedom made possible by use of aggregated, reusable bladders.
Figure 11:
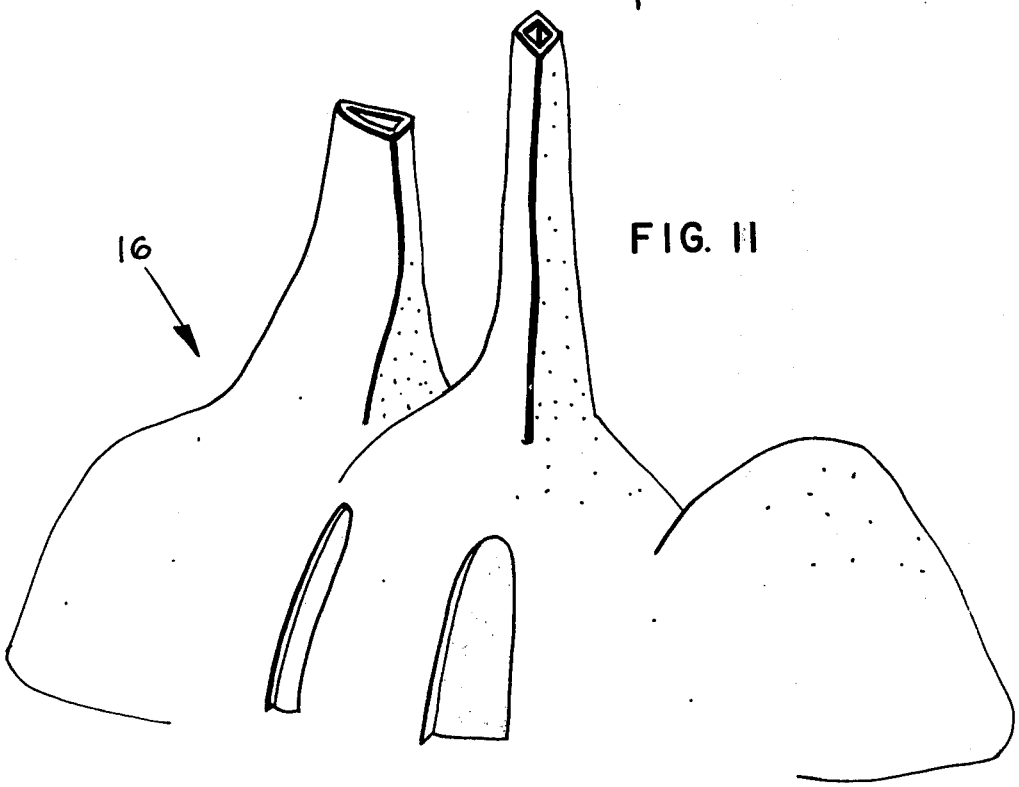

DESCRIPTION OF THE PREFERRED EMBODIMENTS:

In utilizing this method of constructing concrete shells, it is necessary that concrete footers 1 or other typical foundations be prepared prior to the commencement of work on the shell formation. While the typical concrete slab on grade 2 need not necessarily be poured prior to the shell formation, it is necessary that essential service (water, gas, electricity, waste piping etc.) be roughed in and stubbed off at grade in order to facilitate later construction efforts.

Assuming that essential services have been roughed in and that a concrete slab on grade has been poured, the first step in the shell formation process is to transport the empty rubberized fabric bladders to the site. Typically, these bladders 3 would be manufactured from a high strength fabric, possibly reinforced with nylon, and then rubberized or otherwise treated so as to render them waterproof. These bladders could be manufactured in a variety of shapes 4,5,6 and sizes, but the majority of the bladders would be manufactured in that size and configuration which tended to maximize the efficiency of the mold assembly process while minimizing the effects of liquid distortion. (This optimal bladder size and configuration would have been determined during earlier prototype development.)

Each of the bladders is fitted with several fill holes 7, the number of fill holes being dependent upon the size of the bladder. Typically, the fill hole consists of a threaded hose coupling 8 which is fastened to a circular metal plate 9. The rubberized fabric of the bladder is sandwiched between the circular metal plate and a circular metal flange 10 and is securely fastened with a number of rivets 11. The fill hole also is equipped with a threaded metal cap 12. When the fabric bladders are laid out on the concrete slab, the metal caps are removed and water hoses are attached to the hose couplings. To speed up the process of inflating the bladders, several hoses can be attached to a single bladder. When a bladder has been filled, the water hoses are uncoupled and the metal caps are replaced. This process is repeated until all the bladders in the first layer of the form are filled. The workers then unroll additional unfilled bladders and maneuver them so that a second layer of bladders overlaps the first layer of bladders 13. (This overlapping is not unlike that which occurs when bricks are laid in running bond fashion.) This second layer of bladders is then filled, and the process repeats itself until the desired shape of the mold is achieved 14.

Of course, as the height of the mold increases, the number of bladders used at each level diminishes and the typical dome shape develops. The overlapping of the bladders gives the mold stability and tends to reduce the effect of liquid distortion. There may be some loss of water when the hoses are disconnected and the caps threaded into place, but the loss would not be significant. The size of the bladders allows them to be aggregated so that many diverse designs can be realized. Some of the possible design configurations are illustrated in 15,16. Of course there is nothing in this slab or grade 17 shell forming technique which would preclude the mold from being assembled totally below grade 18 or partially submerged 19.

After the mold has been assembled, the casting of the concrete shell is performed in the conventional manner 20. First a wire mesh skin for the mold would have to be fashioned, and some kind of "chair" device employed to insure that the reinforcing mesh and the inflated bladders were properly separated. Also at this time, other forming elements could be attached to the mold and these would serve to "block out" future windows, doors, and skylights. The concrete shell itself would either be poured or sprayed on.

After the concrete shell has hardened, workers merely descend through some of the preformed openings and attach drain hoses to bladders in the uppermost layer 21. Ideally the water could be drained into tank trucks which then transport the water to another job site. As the bladders are sequentially drained, they are pulled up through the preformed openings 22, lowered to the ground, then rolled up and transported to another site where the process repeats itself.

Due to the plurality of bladders that are used in the mold creation process, the interior of the concrete shell will be pockmarked with numerous depressions. Depending upon the thickness of the polyurethane foam which is sprayed on as insulation 23, these depressions can be leveled out or preserved to maintain a rough textured appearance.

I claim:

1. The method of forming concrete shell structures utilizing waterfilled bladders comprised of the following steps:

a. position a plurality of empty bladders of predetermined size and shape to define a first layer generally conforming to the plan of the intended structure b. fill the first layer of bladders with water to form a first layer of inflated bladders;

c. position a second layer of unfilled bladders on top of the inflated preceeding layer in an overlapping manner;

d. fill the second layer of bladders so that the weight of the water and the pattern in which the bladders are arranged tend to stabilize the arrangement of said bladders and minimize the effect of liquid distortion;

e. repeat the above procedure utilizing successive layers of bladders to form a mold with the desired configuration, the surface of the mold so formed consisting solely of the layered, inflated bladders;

f. cover the mold with a layer of wire mesh reinforcing and cast a thin walled concrete shell utilizing commonly accepted construction practice;

g. allow the concrete shell to harden, then successively drain and remove the deflated bladders through preformed openings in the contemplated shell.

* * * * *